United States Patent [19]

Kawamura et al.

[11] 4,337,412

[45] Jun. 29, 1982

[54] CATHODE DEVICE FOR CATHODE-RAY TUBE

[75] Inventors: Takao Kawamura, Chiba; Kuniharu Osakabe, Mobara, both of Japan

[73] Assignee: Hitachi, Ltd., Tokyo, Japan

[21] Appl. No.: 210,672

[22] Filed: Nov. 26, 1980

[30] Foreign Application Priority Data

Nov. 30, 1979 [JP] Japan ..... 54-154409

[51] Int. Cl.[3] ..... H01J 29/96

[52] U.S. Cl. ..... 315/3; 315/57; 315/70; 315/105; 328/255

[58] Field of Search ..... 315/3, 57, 70, 94, 105; 328/270, 255; 313/446

[56] References Cited

U.S. PATENT DOCUMENTS

| | | | |
|---|---|---|---|
| 1,985,058 | 12/1934 | Rath | 315/57 |
| 2,542,493 | 2/1951 | Epstein et al. | 315/57 X |
| 3,374,387 | 3/1968 | Schmid | 315/3 |

*Primary Examiner*—Eugene R. La Roche

*Attorney, Agent, or Firm*—Charles E. Pfund

[57] ABSTRACT

In a cathode-ray tube provided with a direct-heating type cathode, a transformer through which the cathode is heated is disposed within the bulb of the cathode-ray tube. This improvement eliminates the instability of heating due to the contact resistance caused between the base pins of the cathode-ray tube to which the terminals of the cathode are connected and the socket pins to which the base pins are fitted.

5 Claims, 4 Drawing Figures

CATHODE DEVICE FOR CATHODE-RAY TUBE

BACKGROUND OF THE INVENTION

This invention relates to a cathode device for a cathode-ray tube, and more particularly to a direct-heating type cathode device for a cathode-ray tube.

A cathode-ray tube such as, for example, a color picture tube is provided with a cathode adapted to emit three electron beams for causing the phosphor dots of the three primary colors, red, blue and green to luminesce. This cathode includes a metal base mainly containing nickel and a coating of an oxide of barium, for example, deposited to the metal base. The cathode is made to operate by being heated to about 800° C. By the manner in which the cathode heating is effected, cathodes of this type are classified into indirect-heating cathodes which are provided with a separate heater and direct-heating cathodes which are heated by the electric current supplied directly thereto.

In the conventional cathode-ray tube which is provided with a direct-heating cathode, the cathode disposed inside the bulb of the cathode-ray tube is heated with an external power source through the medium of a transformer disposed outside the bulb. To be specific, terminals of the cathode are connected to pins of the cathode-ray tube base and a low-voltage secondary coil of the transformer is connected to pins of a socket adapted to be fitted on the base pins, so as to form a cathode device comprising the cathode and the transformer. In this arrangement, the cathode is heated by feeding thereto voltage of the external power source applied across a high-voltage primary coil of the transformer. Owing to its features such as low power consumption and rapid operation, the cathode-ray tube provided with such a direct-heating cathode device as described above has come to find widespread use.

Incidentally, since the direct-heating cathode is heated by direct supply of an electric current to the cathode itself, the voltage for the heating is lower and the amount of current for the heating is higher than are required in the case of the indirect-heating cathode. For example, the heating voltage and current for each indirect-heating cathode are 6.3 V and 0.25 A, whereas those for each direct-heating cathode are 0.5 V and 1.3 A. Since the heating voltage for the direct-heating cathode is conspicuously low as indicated above, foreign matters and/or oxide film lying between the base pin of the cathode-ray tube and the socket pin remain intact under the application of the voltage for the heating, so that the contact resistance between the base pin and the socket pin is increased, resulting in shortage of heating current and unstable heating.

In the conventional color picture tube which is provided with a cathode device incorporating an external transformer, when operating the cathode, each cathode for three primary color electron beam emission is separately heated and the number of input terminals to the color picture tube will be greater than in the color picture tube using an indirect-heating cathode. While a total of five terminals, i.e. two for the heater and three for the cathodes, suffices for the indirect-heating type, a total of six terminals, i.e. two for each of the three cathodes, is required for the direct-heating type.

SUMMARY OF THE INVENTION

This invention intends to eliminate the above disadvantages suffered by the conventional cathode-ray tube and has for its object to provide a cathode device for a cathode-ray tube which can assure highly stable and reliable heating operation.

To accomplish the above object, according to the present invention, in a cathode device for a cathode-ray tube comprising a direct-heating type cathode disposed inside a bulb of the cathode-ray tube and adapted to emit electron beams for causing a fluorescent screen of the cathode-ray to luminesce and a transformer provided with a low-voltage secondary coil connected to the direct-heating type cathode and a high-voltage primary coil connected to an external power source whereby the direct-heating type cathode is heated by the external power source through the transformer to generate the electron beam emission, the transformer disposed inside the bulb of the cathode-ray tube.

DESCRIPTION OF PREFERRED EMBODIMENT

Figure 1:
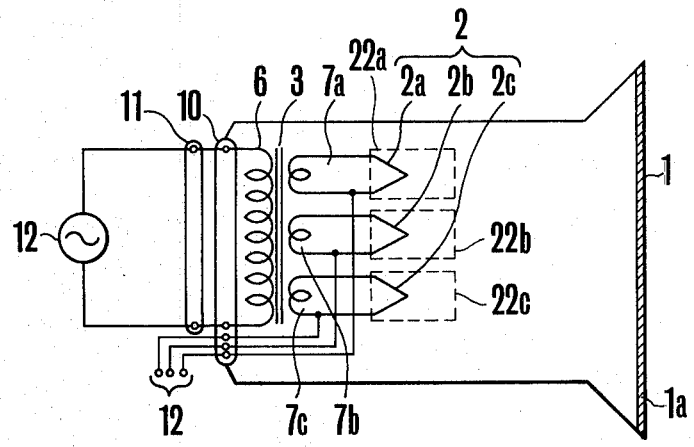
FIG. 1 is a schematic diagram of one preferred embodiment of this invention applied to a color picture tube.

Now, this invention will be described herein below with reference to one embodiment as applied to a color picture tube, a typical form of the cathode-ray tube. As shown in FIG. 1, a direct-heating cathode 2 consisting of three cathodes *2a*, *2b*, *2c* for red, blue and green electron guns *22a*, *22b* *22c* and a transformer 3 serving to isolate the direct-heating cathode 2 from high voltage and to step down voltage of an external power source 12 are disposed inside a bulb 1 of the color picture tube, to form a direct-heating type cathode device for the color picture tube. In this embodiment, since the transformer 3 is disposed within the bulb 1, the secondary coils *7a*, *7b*, *7c* on the transformer 3 through which a large electric current flows under a low voltage are directly connected to the cathodes *2a*, *2b*, *2c* as by welding, for example. A high-voltage primary coil 6 on the transformer 3 is fixedly connected to pins of a base 10 sealed to the bottom of the bulb 1. The pins of the base are fitted to the pins of a socket 11 connected to the external power source 12. Formed on the inner surface of bulb faceplate is a fluorescent screen *1a*.

In the construction described above, the cathode 2 is heated by the external power source 12 through the medium of the transormer 3 disposed inside the bulb 2 to emit electron beams. Since the low-voltage secondary coil of the transformer is directly connected to the cathode, the cathode device is free from the problem of contact resistance entailed by the conventional cathode device. Despite the fact that the lead conductor of the primary coil of the transformer comes in contact with the socket pin at the socket 11, no problem ensues because high voltage is applied to the primary coil. Reference numeral 12 denotes terminals for signals.

When this invention is embodied in a color picture tube as illustrated above, the total of input terminals to be drawn out of the bulb 1 is five, i.e. three signal terminals for the cathodes 2a, 2b, 2c and two terminals for the primary coil 6 of the transformer 3. Thus, the number equals that in the indirect-heating type cathode device.

Figure 2:
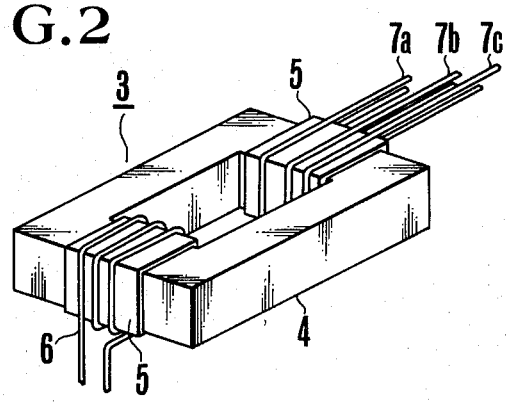
FIG. 2 is a perspective view of a transformer used in the preferred embodiment of FIG. 1.
Figure 3:
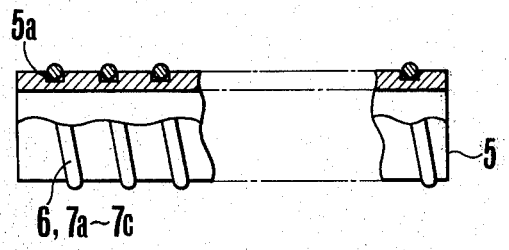
FIG. 3 is a side view, partly sectioned, of a ceramic sleeve used in the transformer of FIG. 2.

Since, in the cathode device of this invention, the transformer is disposed within the bulb, it is undesirable that organic substances are contained which constitute a source of out-gas within the bulb. For this reason, as shown in FIG. 2, the transformer 3 comprises a ferrite core 4, two ceramic sleeves 5 wrapped round the ferrite core, a primary coil 6 of bare copper wire wound round one of the ceramic sleeves and secondary coils 7a, 7b, 7c each of bare copper wire for the three cathodes 2a, 2b, 2c wound round the other ceramic sleeve. Particularly, the winding of coils on the transformer can be effected advantageously by forming grooves 5a on the outer surfaces of the sleeves 5 and laying the coils along the grooves as illustrated in FIG. 3.

Figure 4:
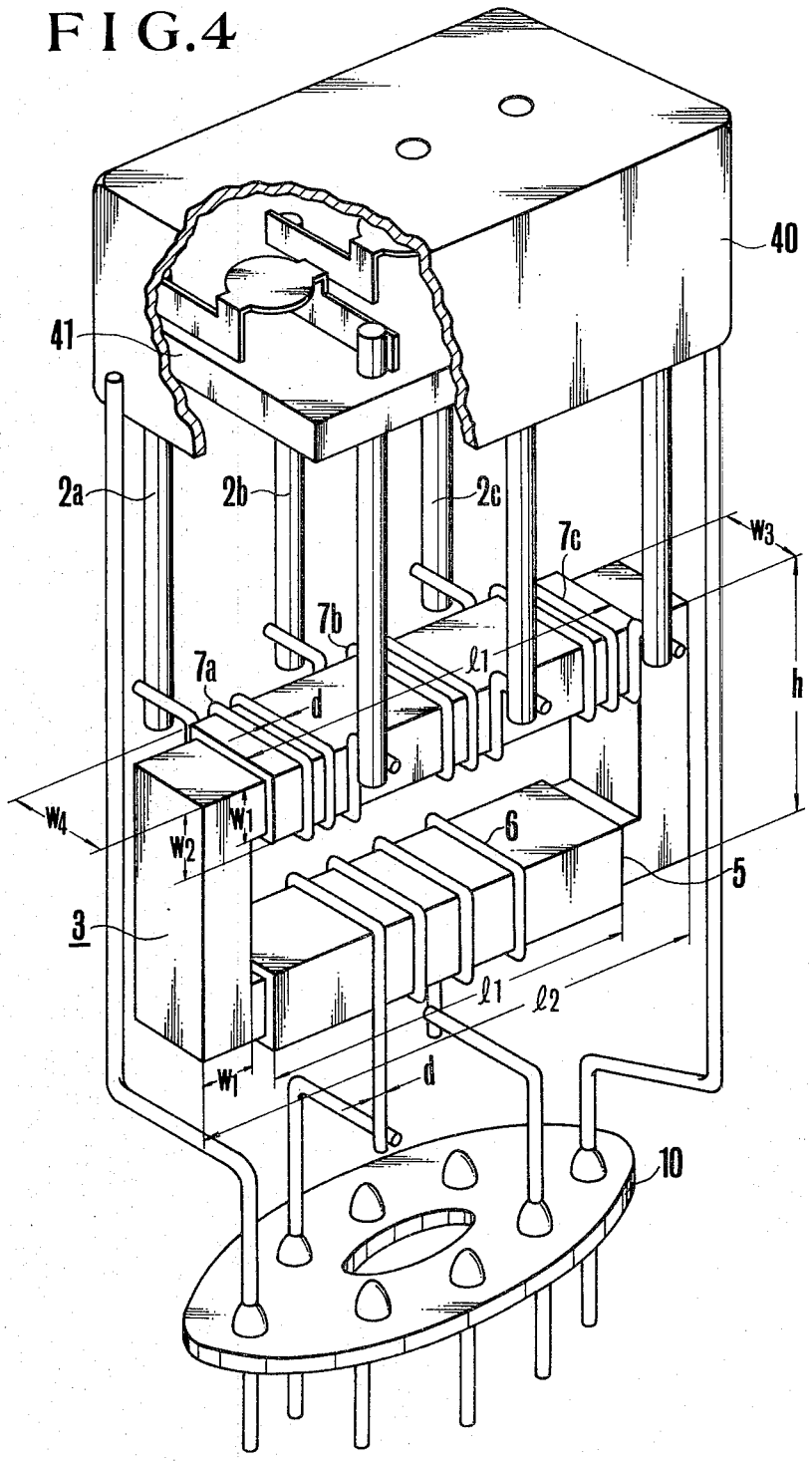
FIG. 4 is an enlarged perspective view, partly exploded, illustrating the construction adapted to support within the bulb the transformer used in the embodiment of FIG. 1.

Now, the mounting structure for the cathode device of this invention within the bulb of the cathode-ray tube will be described by way of a color picture tube with reference to FIG. 4. In the figure, the dimensions are: d=0.6 mm, l1=15 m, l2=20 mm, w1=2 mm, w2=3 mm, w3=4 mm, w4=5 mm, and h=12 mm. For the transformer of this size to be stably supported in position, it suffices to have the terminals of the primary coil 6 connected to the pins of the base 10 and the secondary coils 7a, 7b, 7c connected to the cathodes 2a, 2b, 2c respectively which are supported by a ceramic plate 41 secured to G1 grid electrode 40 of the electron gun. While such a supporting structure has an advantage that it can be held in position by making use of the conventionally adopted lead wires, the transformer may otherwise be supported by means of a suitable support member not shown.

Since the cathode device for the cathode-ray tube according to the present invention enables the heating of the cathode to be stabilized as described above, it brings about a prominent effect of enhancing the reliability of the cathode-ray tube.

What is claimed is:

1. In a cathode device for a cathode-ray tube comprising a direct-heating type cathode disposed inside a bulb of the cathode-ray tube and adapted to emit electron beams for causing a fluorescent screen of the cathode-ray tube to luminesce and a transformer provided with a low-voltage secondary coil connected to the direct-heating type cathode and a high-voltage primary coil connected to an external power source whereby the direct-heating type cathode is heated by the external power source through the transformer to generate the electron beam emission, the improvement wherein said transformer is disposed inside said bulb.

2. The cathode device according to claim 1, wherein said transformer is supported within said bulb by means of the primary coil having the terminals thereof connected to the pins of a base of the cathode-ray tube and the secondary coil having the terminals thereof connected to the direct-heating type cathode.

3. The cathode device according to claim 1, wherein the transformer comprises a ferrite core and the primary and secondary coils are wound round said ferrite core through the medium of ceramic sleeves.

4. The cathode device according to claim 3, wherein said ceramic sleeve has grooves formed in the outer surface thereof and said coils are laid along said grooves.

5. The cathode device according to claim 1, wherein the cathode-ray tube is a color picture tube.

* * * * *

UNITED STATES PATENT AND TRADEMARK OFFICE

CERTIFICATE OF CORRECTION

PATENT NO. : 4,337,412

DATED : June 29, 1982

INVENTOR(S) : Takao Kawamura and Kuniharu Osakabe

It is certified that error appears in the above—identified patent and that said Letters Patent is hereby corrected as shown below:

Column 3, line 22, change "11 = 15 m," to -- ℓ1 = 15 m,--.

change "12 = 20 mm," to -- ℓ2 = 20 mm,--.

Signed and Sealed this

*Fourteenth* Day of *September 1982*

[SEAL]

*Attest:*

GERALD J. MOSSINGHOFF

*Attesting Officer*

*Commissioner of Patents and Trademarks*